US006142850A

United States Patent [19]

Levy

[11] Patent Number: 6,142,850

[45] Date of Patent: Nov. 7, 2000

[54] YO-YO CONSTRUCTION KIT

[75] Inventor: Edwin Levy, Huntingdon Valley, Pa.

[73] Assignee: Penn State Industries, Philadelphia, Pa.

[21] Appl. No.: 09/420,423

[22] Filed: Oct. 19, 1999

[51] Int. Cl.[7] ..... A63H 1/30

[52] U.S. Cl. ..... 446/250

[58] Field of Search ..... 446/248, 250, 446/251, 252, 255

[56] References Cited

U.S. PATENT DOCUMENTS

| | | | |
|---|---|---|---|
| 1,806,485 | 5/1931 | Mirafuentes | 446/250 |
| 4,207,701 | 6/1980 | Kuhn | 446/250 |
| 5,813,897 | 9/1998 | Van Dan Elzen et al. | 446/250 |
| 5,984,759 | 11/1999 | O'Sullivan | 446/251 |

FOREIGN PATENT DOCUMENTS

| | | | |
|---|---|---|---|
| 854923 | 11/1970 | Canada | 446/250 |

*Primary Examiner*—Jacob K. Ackun
*Assistant Examiner*—Jeffrey D. Carlson
*Attorney, Agent, or Firm*—Gregory J. Gore

[57] ABSTRACT

A yo-yo kit comprises precise metal fitting parts which provide the accuracy and ease of assembly. Metal sleeves are pressed into each yo-yo half. The sleeves provide a mounting point for turning the yo-yo halves and also carry compressive forces of the axle. During assembly, the sleeves are affixed to each body half by an adhesive such as an epoxy glue. Inner and outer hubs located at the ends of the sleeve of each body are rigidly press-fitted into each sleeve. The outer hubs include blind threaded apertures which receive the threaded ends of the axle to secure the parts in a rigidly assembly. The inner hubs are likewise press-fitted into the other ends of the sleeves and act both as radial spacers between the axle and the sleeve and also capture a centrally mounted ball bearing between opposing flanges on their respective inner facing surfaces. The inner hubs also include friction grooves to increase friction between the spinning yo-yo and the string which operates the yo-yo.

12 Claims, 1 Drawing Sheet

11
13
15
2
21
22
23
25
26
27
28
41
43
44
45
46
47

YO-YO CONSTRUCTION KIT

FIELD OF THE INVENTION

The invention is in the field of hand manipulated toys, specifically yo-yos.

BACKGROUND OF THE INVENTION

The modern yo-yo toy is a fairly sophisticated device that has passed through various stages of technical refinement over the years. A typical yo-yo includes two identical body section halves interconnected by an axle at the center. A string tether is looped about the axle, and by manipulating the string in a well known fashion, the yo-yo may be able to spin and be drawn up and down. The at-home do-it-yourself craft industry is a growing part of our economy, and hand-crafted items such as toys are a large segment of that industry. One of the craft industry's popular tools for creating home projects is the wood lathe that can be used to turn out different woodcraft products. The yo-yo is one of the toys that is desired by crafts people to produce on a wood lathe because yo-yos are of simple circular construction.

A problems exists, however, in the more sophisticated yo-yo designs which employ ball bearings to increase yo-yo performance. These are difficult to adapt to the at-home craft industry which must utilize relatively simple materials such as wood to form the body of the yo-yo. By its nature the ball bearing is a separate structure which must be installed over an axle. Accurately locating and centering the ball bearing and complementing it with the necessary friction producing side surfaces is difficult to achieve with accuracy even in large-scale manufacturing. For an at-home craft project this difficulty is increased, and it is an extremely difficult task for the craft person to produce his own high performance ball-bearing type yo-yo. There has therefore been demonstrated a need in the art for a "kit" that may be successfully employed with the limited skills and materials of a home-craft person.

Pertinent prior art of which the applicant is aware which employs the use of sophisticated ball-bearing yo-yos is U. S. Pat. No. 5,813,898. Other prior art which shows the use of a yo-yo which may be constructed from an assembly of parts includes, for example, U. S. Pat. No. 4,207,701 which shows the use of yo-yo body halves which may be disassembled and inverted to provide a different appearance. In both cases, however, the components of the yo-yo require critical dimensioning of parts or finely tapered surfaces which are difficult to achieve by the typical home-craft woodworker who is restricted to the most simple operations such as rudimentary wood turning, drilling and gluing. A home-craft yo-yo kit is heretofore unknown that is capable of producing an acceptable technologically sophisticated ball-bearing type yo-yo.

SUMMARY OF THE INVENTION

The present invention provides the result of a ball-bearing type yo-yo in which only the simple manufacturing processes are required. Furthermore, the kit requires that the body of the yo-yo be made only of easily obtainable types of wood. Because wood is used, the kit further provides for the limitations of the wood material in which the compression of assembly forces is not transmitted directly to the wood and that the metal pieces of the kit permit the wood some allowance for contraction and expansion. The components of the kit are precise fitting metal parts which provide the accuracy of assembly and alignment required by a ball bearing yo-yo.

Specifically, the present invention utilizes metal sleeves which are pressed into each yo-yo half. The sleeves both center and align the ball bearing carrying axle as well as withstand the compression forces of assembly necessary to rigidly secure the ball bearing and body halves in place. During assembly, the sleeves are affixed to each body half by an adhesive, such as an epoxy glue. Inner and outer hubs located at the ends of the sleeve of each body half are rigidly press-fitted to each sleeve. The axle is an elongated member with a smooth outer surface that is accurately dimensioned to be closely received through bores of the inner hubs and the bearing race. These inner hubs act as radial spacers between the axle and the sleeves and also capture the ball bearing between opposing flanges on their respective inner-facing surfaces. The outer hubs include blind-threaded holes and a smooth outer surface that caps the ends of the axle to provide an esthetically pleasing appearance. The ends of the axle include male threads which engage the threaded bores of the outer hub caps. This structure explained above will be described in more detail with regard to description of the preferred embodiment which follows.

The invention permits simple woodworking processes such as lathe turning and drilling to be employed while providing a resulting yo-yo that includes the sophisticated ball-bearing construction. This is accomplished by the mechanical relations of the present invention which restricts all close tolerancing of parts to the metal components provided with the kit. Furthermore, a simple, readily available, easily worked material for the body half such as a soft wood may be used. Because the body halves do not absorb any of the compressive forces of assembly since they are not held under compression, expansion and contraction of the wood over time is also permitted to occur without cracking the wood.

Other objects and advantages of the present invention will be readily understood by those of ordinary skill in the art to which the invention pertains from the following drawings and description of the preferred embodiment.

DESCRIPTION OF THE PREFERRED EMBODIMENT

Figures 1, 2, 3, 4:
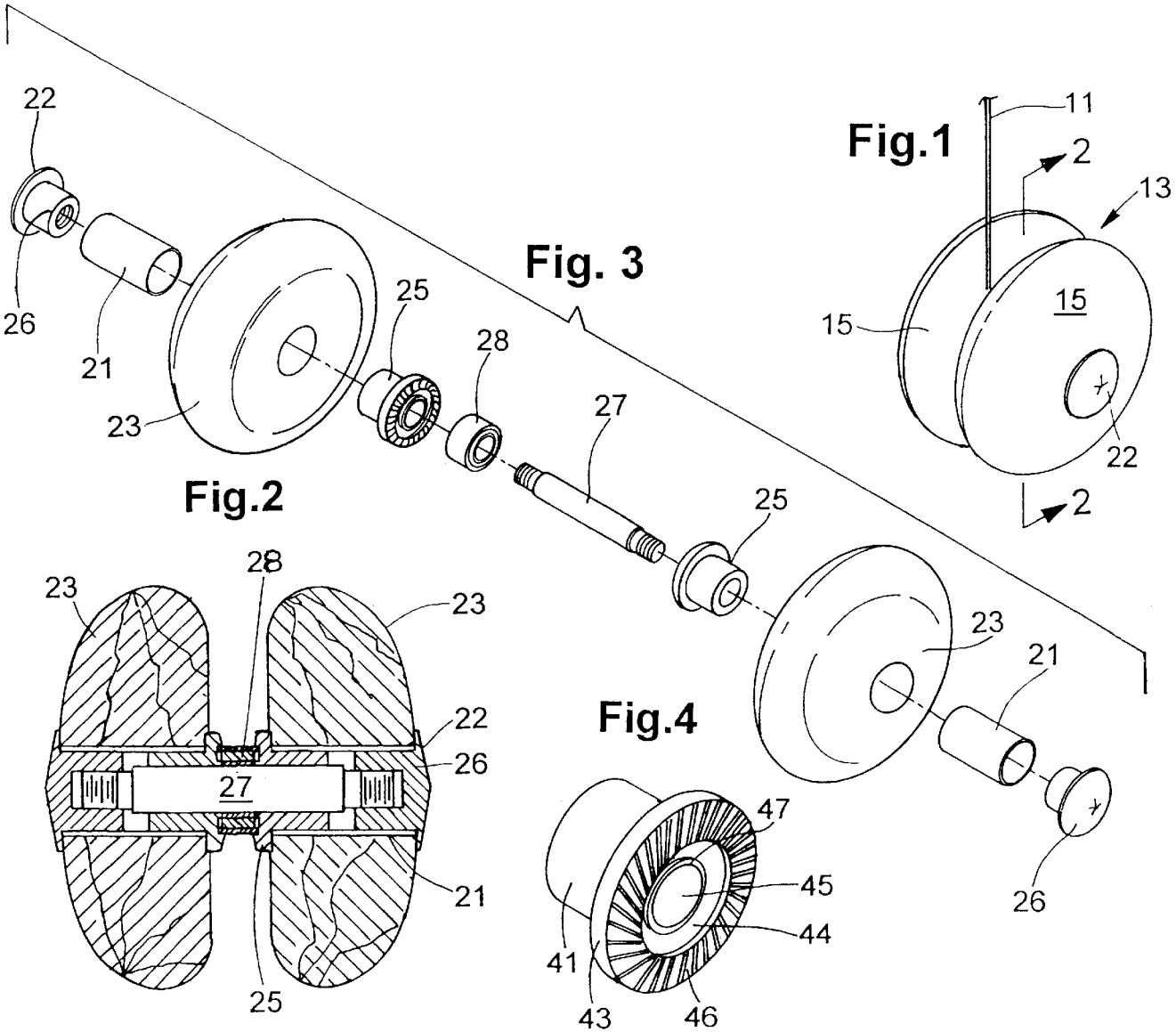
FIG. 1 is a top right isometric view of the present invention.
FIG. 2 is a front sectional view taken from FIG. 1 as shown in that figure.
FIG. 3 is an exploded assembly view showing all of the component parts of the present invention.
FIG. 4 is an top right isometric view of an inner hub of the invention.

FIG. 1 shows the present invention which appears as a typical yo-yo 13 that has smooth-shaped body halves 15. The yo-yo is manipulated by string 11 which draws the yo-yo up and down and makes it perform various yo-yo tricks. Metal hub cap 22 is substantially continuous with the outer surface of body half 15 and maintains the smooth outer appearance of the yo-yo. Utilizing metal as the material for the outside hubs allow these exposed components to be a further decorative asset by finishing them with gold, silver or chrome plating.

Referring now to FIG. 2, each yo-yo half 23 is identical and located opposite the other across from a center plane, each being a mirror image of the other; and, therefore, a description of one half only will accurately describe the other without further explanation. Referring to right-side body half that appears in this figure, sleeve 21 is one of the critical elements of the invention which permits its advantageous construction. The sleeve is fitted into a hole drilled into wooden body half 23 and is thereafter secured by an adhesive such as an epoxy glue. Inner hub 25 is forcibly press-fit into sleeve 21. The inner hub is itself a sleeve which includes an axial bore that receives axle 27. Like the inner hub, the outer hub cap 26 is forcibly press-fit into the opposite end of sleeve 21 until the underside of the cap which forms an annular flange around shank of the hub abuts the end of the sleeve. As an alternative, the hubs could be attached to the sleeves by threaded engagement. This would provide the hobbyist with the ability to completely disassemble the components from the yo-yo halves and re-assembled with different sets of yo-yo halves desired. Thus by the press-fitting and gluing described herein, each wooden body half comprising a sleeve and two hubs all become rigidly assembled. An axle 27 supports bearing 28 and includes ends with male threads which engage a blind threaded hole in each outer hub cap to threadably secure the yo-yo in its assembled condition. Bearing 28, preferably of the ball type, has an inner diameter equal to the bore of the inner hubs 25, and axle 27 passes through the entire assembly to accurately center both body halves to the ball bearing and rigidly affixes the body halves together. As a further refinement, the gap between the yo-yo halves can be regulated by counter-sinking the inner hubs 25 into each yo-yo half.

Referring now to FIG. 3, an exploded assembly drawing shows yet greater detail of the individual components which comprise the present invention. All parts are assembled about axle 27 which extends through substantially the entire width of the assembly. Since the threaded outer hubs 26 are forcibly joined to the sleeve 21 of each body half 23, the assembly may be tightened simply by manually turning each body half with respect to the other. Since the compressive forces of each body half are entirely carried by the sleeves 21, tension on the threads can adequately be maintained, being unaffected by expansion or the contraction the wooden halves 23.

FIG. 4 depicts greater detail of one of the inner hubs which are a critical feature of the invention. The complete yo-yo utilizes two inner hubs that are identical so a description need only be given of one. One inner hub shown in FIG. 4 comprises three basic structural components: a shank 41, a flange 43, and an axial bore 45 which receives the yo-yo axle when assembled. The outside diameter of the shank 41 is dimensioned to provide an accurate and rigid press-fit with the sleeve of the yo-yo half into which it is installed according the diagram of FIG. 3. The inner facing end of the hub includes a flange 43 which abuts the end of its respective body half sleeve when it is fully installed. The flange has an annular recess 44 and a stand-off collar 47 directly adjacent the mouth of the bore 45 in the center of the recess. The recess receives the side of the bearing so that the face of the flange is positioned closer to the string. The stand-off collar 47 abuts the inner race of the ball bearing when installed and holds the outer race away from the inner hub so that it turns freely. The inner hubs also conveniently include friction grooves 46 of the type that are commonly known to be used with ball-bearing type yo-yos to provide increased friction between the rotating body halves and the string. These friction grooves are important in permitting a ball-bearing type yo-yo to perform properly. By providing these grooves on the inner-facing surface of the inner hubs, separate structures for providing this added frictional surface or cutting them into the inside surfaces of the body halves are not necessary. Thus, this construction provides an assembly of fewer parts that would otherwise be required. The annular face of the inner hub flange is also tapered to its edge away from the center plane to provide greater clearance for build-up of the string at points farther from the bearing. This can be seen more clearly in FIG. 2.

A kit for the hobbyist woodworker comprises all of the components shown in FIG. 3 except the wooden body halves which are supplied by the hobbyist and shaped on a wood lathe by him or her. All elements of the kit are precision manufactured metal parts which provide an extremely accurate alignment and a rigidly assembled final product. The recommended steps in completing the yo-yo from this kit are as follows.

A stock board is planed to ⅝ inches thick. Two blanks are then cut into 2 ½ inch squares. At the center of each blank a 10 millimeter hole is then drilled through each. The corners of the blanks are then cut and trimmed to make them easier to turn on the lathe.

An epoxy glue is then applied to the outside of the metal sleeves supplied with the kit which are then inserted into the holes in the blanks. Once the glue has dried, the halves are ready for turning by mounting both halves side by side on a mandrel between the centers of a wood lathe utilizing the sleeves as the mounting point. The sleeves thus provide an accurate center axis of the body halves. Proper alignment after assembly is assured after assembly since both halves are turned at the same time.

After the body halves are turned, the metal outer hubs are pressed into the sleeves at the outer side of each half until the flanges of the metal hubs abut the ends of the sleeves. Next, the metal inner hubs are then similarly pressed into the ends of the sleeves at the opposite side of each half. This may be easily achieved by the hobbyist since no special tools, adhesives, fasteners or tooling are required. The ball bearing is inserted over the axle which is then threaded into the hub cap of one body half until it bottoms out. The second body half is then inserted over the axle which is in turn threaded into the hub cap of the second body half by manually turning the body halves in opposite directions. The string is then looped over the axle, and the completed yo-yo is ready to perform. The present designs lends itself to easy assembly and disassembly of the yo-yo halves for removing a tangled string and for repairing, cleaning or replacing the bearing.

It will be readily understood by those of skill in the art that one of the unique advantages of the structure and methodology of constructing the yo-yo given the above-described steps is that the metal sleeves which are glued into each body half provide the dual purpose of a rigid structure for mounting the body halves during turning on the lathe and therefore later provide accurate alignment of the axle during assembly of the completed product. This ensures that the rotational axis of the completed yo-yo is accurately established and reliably maintained.

There may be other modifications and adaptations of the present invention which will be readily apparent to those of ordinary skill in the art. For example, the present design also lends itself to be used without a bearing to provide a more spontaneous return action. Furthermore, the present invention lends itself to fabrication and assembly with numerous difference materials including wood, plastic, light metals, clay or any other material that can be machined or cast. However, the scope of the invention is to be determined only by the scope of the following claims and their legal equivalents.

What is claimed is:

1. A yo-yo having identical opposing body halves joined by an axle which defines an axis rotation, comprising;

a pair of substantially identical body halves, each half comprising a sleeve closely fitted into and passing entirely through a hole drilled through each body half along the axis of rotation;

a pair of inner hubs each rigidly press-fitted into an inner-facing first end of each of said sleeves, said inner hub including a bore coaxial with said axis of rotation and having a flange which abuts said first end of said sleeve; and a pair of outer hubs each rigidly press-fitted into a second outer-facing end of each of said sleeves, said outer hub having a threaded aperture threadably engaging one end of said axle, said outer hub further including a flange which abuts said second end of said sleeve.

2. The yo-yo of claim 1 further described in that the ends of said axle threadably engage a blind threaded bore of each outer hub.

3. The yo-yo of claim 2 further including a ball bearing carried by said axle and being located between said body halves, said bearing being forcibly held in compression between the inner hubs.

4. The yo-yo of claim 3 further including a bearing-receiving circular recess located on the inner-facing surface of each inner hub flange centered on said access, said recesses receiving opposite sides of said bearing.

5. The yo-yo of claim 4 wherein the inner facing surfaces of said inner hubs comprise a tapered annular ring.

6. The yo-yo of claim 5, wherein the inner hub flanges each has a plurality of grooves on its inner-facing surface.

7. The yo-yo of claim 6, further including a stand-off collar around the bore of said inner hub located within said recess.

8. The yo-yo of claim 7, wherein the outer hubs of each body half are further described as having blind threaded apertures and smooth outer-facing surfaces.

9. The yo-yo of claim 8, wherein the sleeves are affixed to their respective body halves by an adhesive.

10. The yo-yo of claim 1 wherein stated inner and outer hubs are metal.

11. The yo-yo of claim 10 further described in that outer hubs have a metal plate.

12. A method of assembling a yo-yo from a kit of parts, comprising the steps of:

providing two body half blanks;

drilling a hole through the center of each blank;

applying glue to the outsides of two sleeves;

inserting each sleeve into the hole of each blank;

shaping the blanks by turning them on a lathe, utilizing the sleeves as the mounting points;

press-fitting inner hubs into a first end of each sleeve;

press-fitting outer hubs with flanges into a second end of each sleeve such that said flanges of said outer hubs abut the second ends of each sleeve;

threading an axle into the outer hub of one body half;

inserting a ball bearing over the axle;

inserting the second body half over the axle;

manually rotating the body halves in opposite directions thereby threading the axle into the outer hubs of each body half until the halves become rigidly affixed to one another; and looping a string over the axle between the body halves.

* * * * *